US008740116B2

(12) United States Patent
Lefkovitz

(10) Patent No.: US 8,740,116 B2
(45) Date of Patent: Jun. 3, 2014

(54) ESSENCE EXTRACTING DRINKING VESSEL

(76) Inventor: Joshua A. Lefkovitz, Akron, OH (US)

( * ) Notice: Subject to any disclaimer, the term of this patent is extended or adjusted under 35 U.S.C. 154(b) by 182 days.

(21) Appl. No.: 13/219,985

(22) Filed: Aug. 29, 2011

(65) Prior Publication Data

US 2013/0199949 A1 Aug. 8, 2013

Related U.S. Application Data

(63) Continuation-in-part of application No. 12/961,828, filed on Dec. 7, 2010, now Pat. No. 8,613,402.

(51) Int. Cl.
*A47J 31/44* (2006.01)

(52) U.S. Cl.
USPC ..... 241/69; 99/510; 241/169.1

(58) Field of Classification Search
USPC ..... 99/501, 506, 508, 510, 513, 505; 241/100, 69, 169.1
See application file for complete search history.

(56) References Cited

U.S. PATENT DOCUMENTS 6,539,848 B2 * 4/2003 Wang et al. ..... 99/508
2007/0272091 A1 * 11/2007 Hsien ..... 99/501

* cited by examiner

*Primary Examiner* — Mark Rosenbaum
(74) *Attorney, Agent, or Firm* — John Gugliotta

(57) ABSTRACT

An improved hand operated citrus press is provided in direct operational combination with a liquid drinking vessel. The citrus press is provided removably connected to, and in fluid communication with, the liquid drinking vessel. The fluid contained within the drinking vessel can be infused with the essences from the ground or comminuted fruit from the citrus press. The fluid communication between the comminuting volume of the citrus press grinder assembly and the container allows these all natural ingredients to steep directly with the beverage, creating refreshingly flavored drinks.

14 Claims, 7 Drawing Sheets

ESSENCE EXTRACTING DRINKING VESSEL

RELATED APPLICATIONS

The present invention is a Continuation in Part of U.S. Ser. No. 12/961,828, filed on 7 Dec. 2010 now U.S. Pat. No. 8,613,402, and incorporated by reference as if fully rewritten herein.

BACKGROUND OF THE INVENTION

1. Field of the Invention

The present invention relates generally to an essence extractor for comminuting for the extraction of edible and aromatic oils and, more particularly, to a hand grinding citrus press in combination with a liquid drinking vessel for the direct blending of freshly extracted citrus juice, oils and such into a drinking liquid in a continuous manner.

2. Description of the Related Art

Hand-held citrus presses are kitchen tools that are well known in the art. A typical design that is standard in commerce is an inverted cone or crown having alternating reamer blades and spaced slots upon which a citrus fruit such as a lemon, lime or grapefruit is manually impinged, twisted and grinded to allow for the release of fruit, juice, and oil. The blades scrape the fruit, while the slots are generally sized to allow passage of liquid while preventing passage of pits or seeds.

The use of such a hand held citrus press is capable of easily extracting the juice of one or a few fruit, but its use to create a citrus beverage is cumbersome, inefficient and generally not acceptable. High speed electronic >juicers= are currently available specifically for the creation of a fruit beverage, but such devices are cumbersome, expensive, creates excessive cleanup, and is generally looked at as >overkill= for the production of a single glass of citrus infused water or a similar essences infused beverage.

Consequently, a need does exist for providing a simple, easy, intuitively operated and inexpensive portable apparatus and method for the extraction of edible and aromatic oils with the purpose of directly blending or combining the fruit and the freshly extracted edible and aromatic oils and such with a liquid in a sealed drinking bottle.

SUMMARY OF THE INVENTION

It is therefore an object of the present invention to provide an improved essence extractor for comminuting of foodstuffs for the extraction of edible and aromatic oils in a drinking bottle.

It is a feature of the present invention to provide a hand grinding citrus press in combination with a liquid drinking vessel for the direct blending of freshly extracted citrus juice, oils and such into a drinking liquid while keeping the fruit separate from the liquid.

Briefly described according to one embodiment of the present invention, a hand operated citrus press of a generally conventional design is provided in direct operational combination with a liquid drinking vessel. The citrus press is provided removably connected to, and in fluid communication with, the liquid drinking vessel. The container, adapted as a drinking vessel, in which a drinking beverage contained therein can be infused with the essences from the ground or comminuted fruit from the citrus press. The citrus press can be internal or external to the vessel; either design will still result in direct infusion. The fluid communication between the comminuting volume of the citrus press grinder assembly, the fruit itself, and the container allows these all natural ingredients to steep directly with the beverage, creating refreshingly flavored drinks. When adapted for use with drinking water, a sport cap may be provided to provide a spill-proof sip.

In any such embodiment, the container can be modified to be operatively connected to the citrus press such that it is removably connected to the liquid dispensing container, as well as in fluid communication with the liquid volume while maintaining a sealed contained beverage. Therefore, the user can consume the liquid while the citrus press is still attached to the container, or the citrus press can removed prior to consuming the liquid. Placement of the citrus press can be the top, middle, bottom, or any specific orientation or configuration should be equivalent, given the fluid communication between the comminuted foodstuff and the liquid volume such that the extraction of edible, the edible itself, and aromatic oils can directly blend with any liquid contents of the volume.

An advantage of the present invention is that it allows the direct blending for freshly extracted edible, the edible itself, and aromatic oils from the fruit and such with a target diluent, such as water, effervescent water, vodka, etc., while allowing the user to drink from the vessel without first removing the citrus press.

Further, a preferred embodiment of the present invention is capable of being effectively hand operated, repeatedly used, easily cleaned and economical to obtain and operate.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
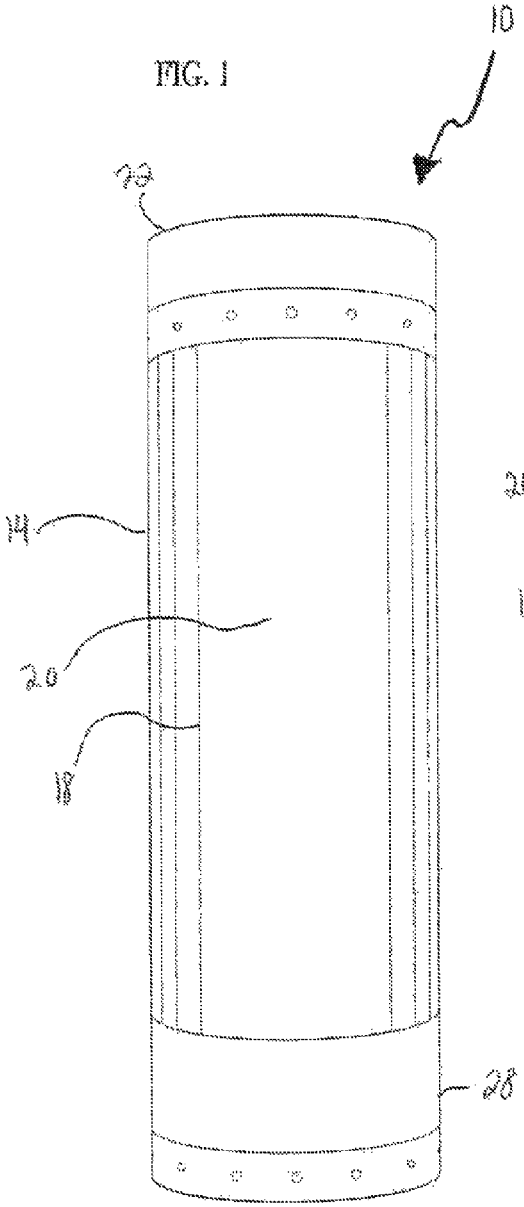
FIG. 1 is a front elevational view of a hand grinding citrus press in combination with a liquid drinking vessel according to one embodiment of the present invention.
Figure 2:
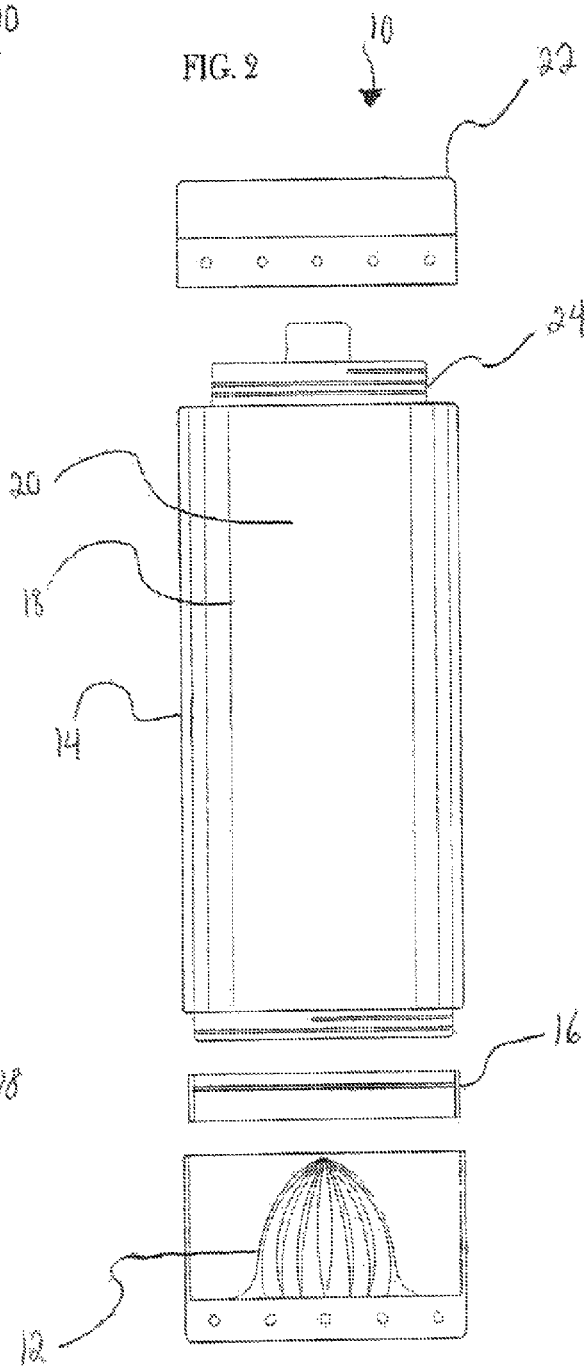
FIG. 2 is an exploded elevational view thereof.
Figure 3:
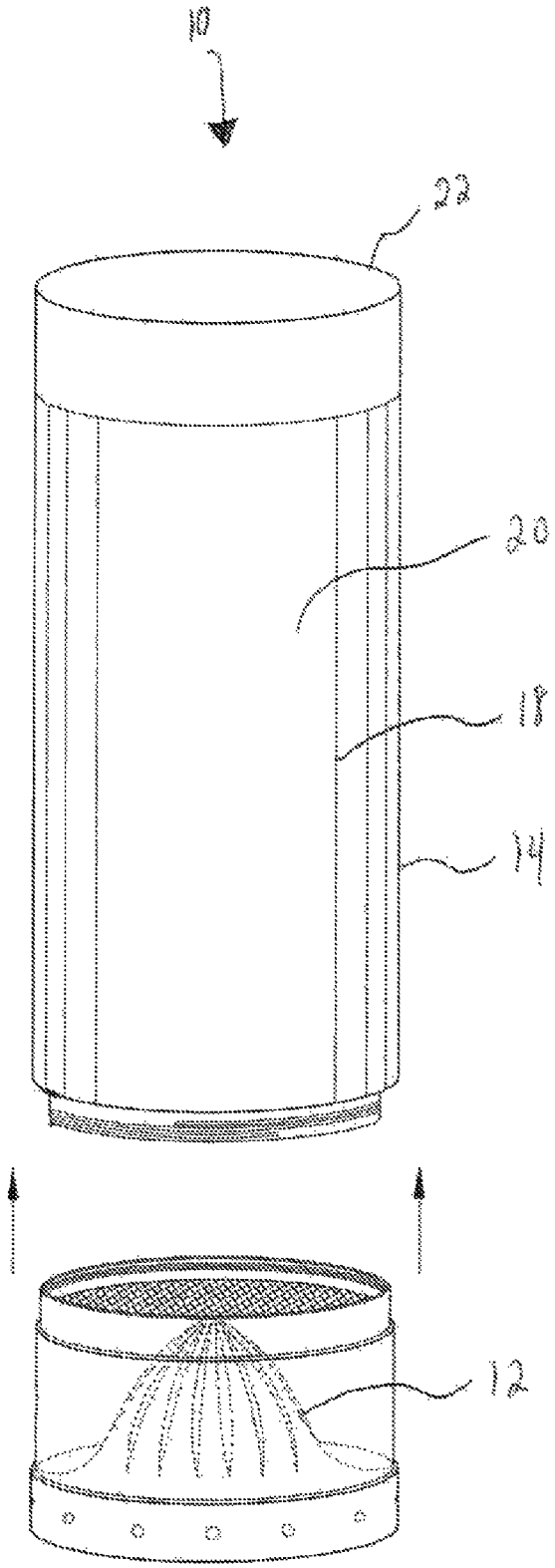
FIG. 3 is a partially exploded perspective view thereof.

Referring now to FIGS. 1-3, a hand grinding citrus press and juice extractor and liquid container combination, generally noted as 10, is shown according to one embodiment of the present invention incorporating a citrus press 12 or hand operated fruit grinder assembly is removably attacked to, and in fluid communication with, a liquid drinking vessel 14. A retention or separation sieve or separation mechanism 16 may be affixed between the citrus press 12 and drinking vessel 14 to allow for fluid communication between the extracted juices of the fruit, with retention of seed, rind or even pulp, depending upon the desired sieve 16 size.

The liquid vessel 14 is anticipated as being formed of stainless steel, or a clear polycarbonate or epoxy plastic that is free of PBA (Bis-Phenol A) to form a viewing window 18 allowing visual access to the dispensing volume 20. The vessel 14 itself may be adapted to any number of industrial designs and for various purposes. By way of example, the preferred embodiment is a drinking bottle having an upper replaceable lid 22 that is threadingly engaged with an upper opening 24 of the vessel 14. However, the vessel 14 way be adapted for use in conjunction with other uses.

Figure 4:
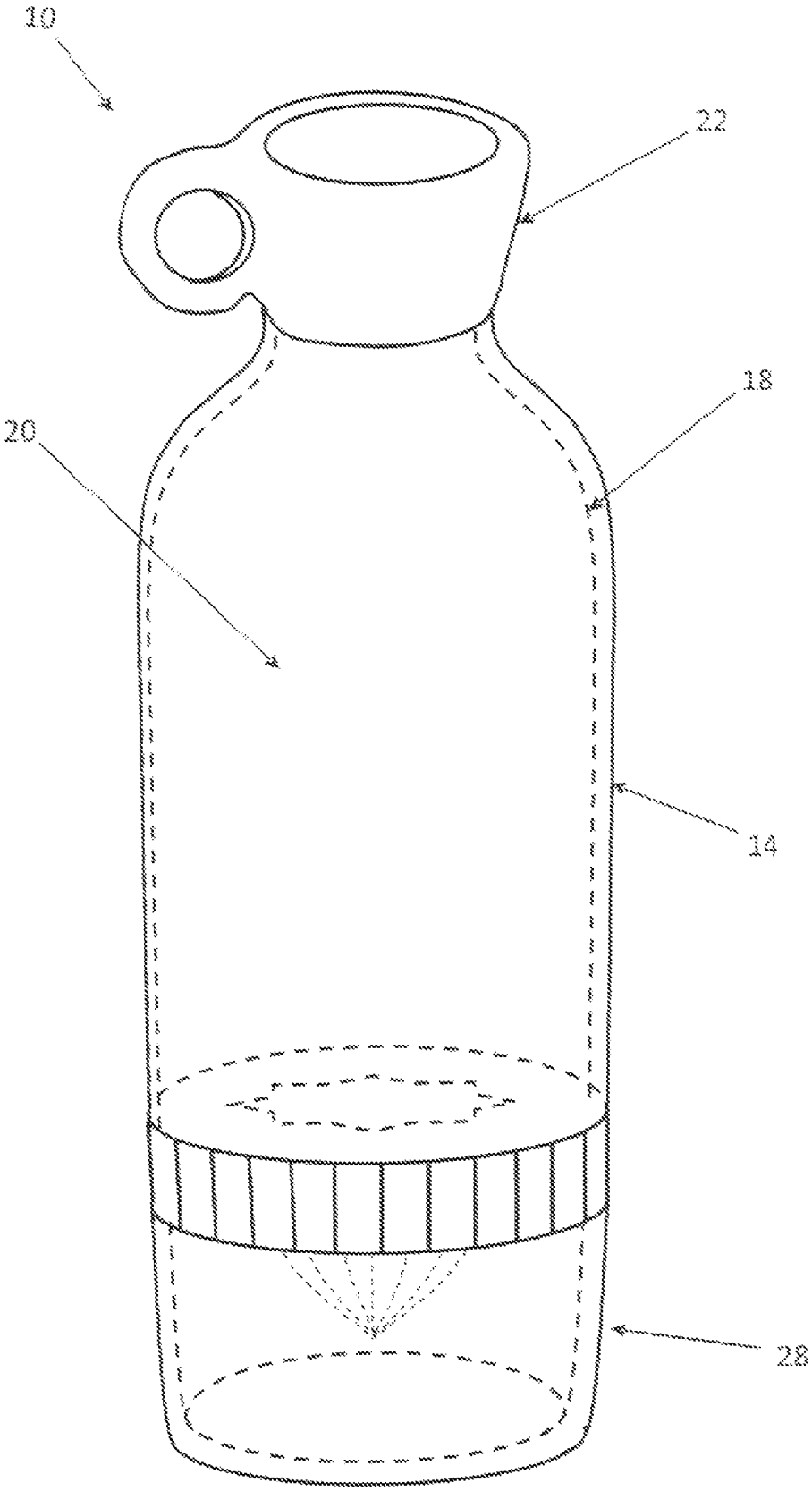
FIG. 4 is a front elevational view of a hand grinding citrus press in combination with a liquid drinking vessel according to another embodiment of the present invention.
Figure 5:
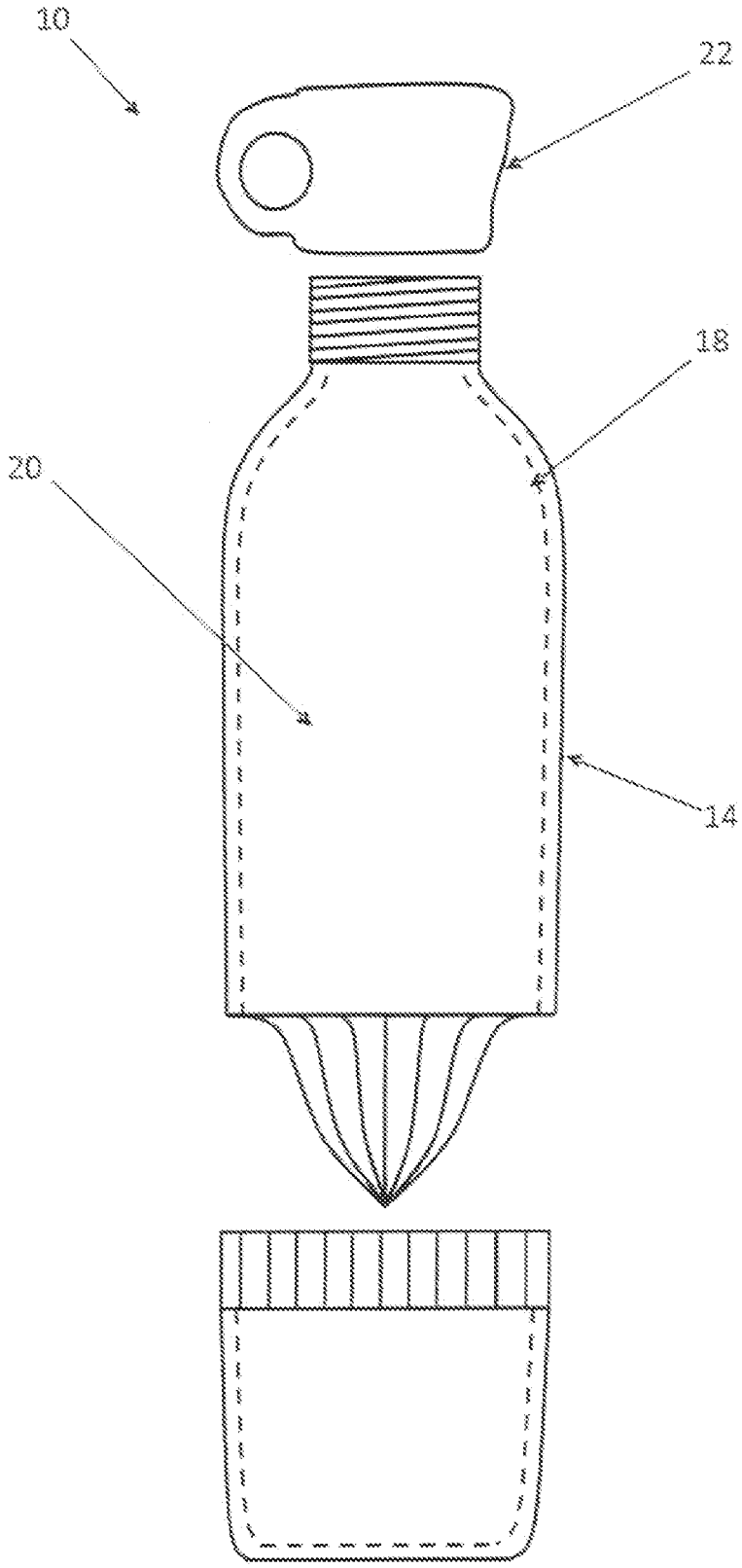
FIG. 5 is an exploded elevational view thereof.
Figure 6:
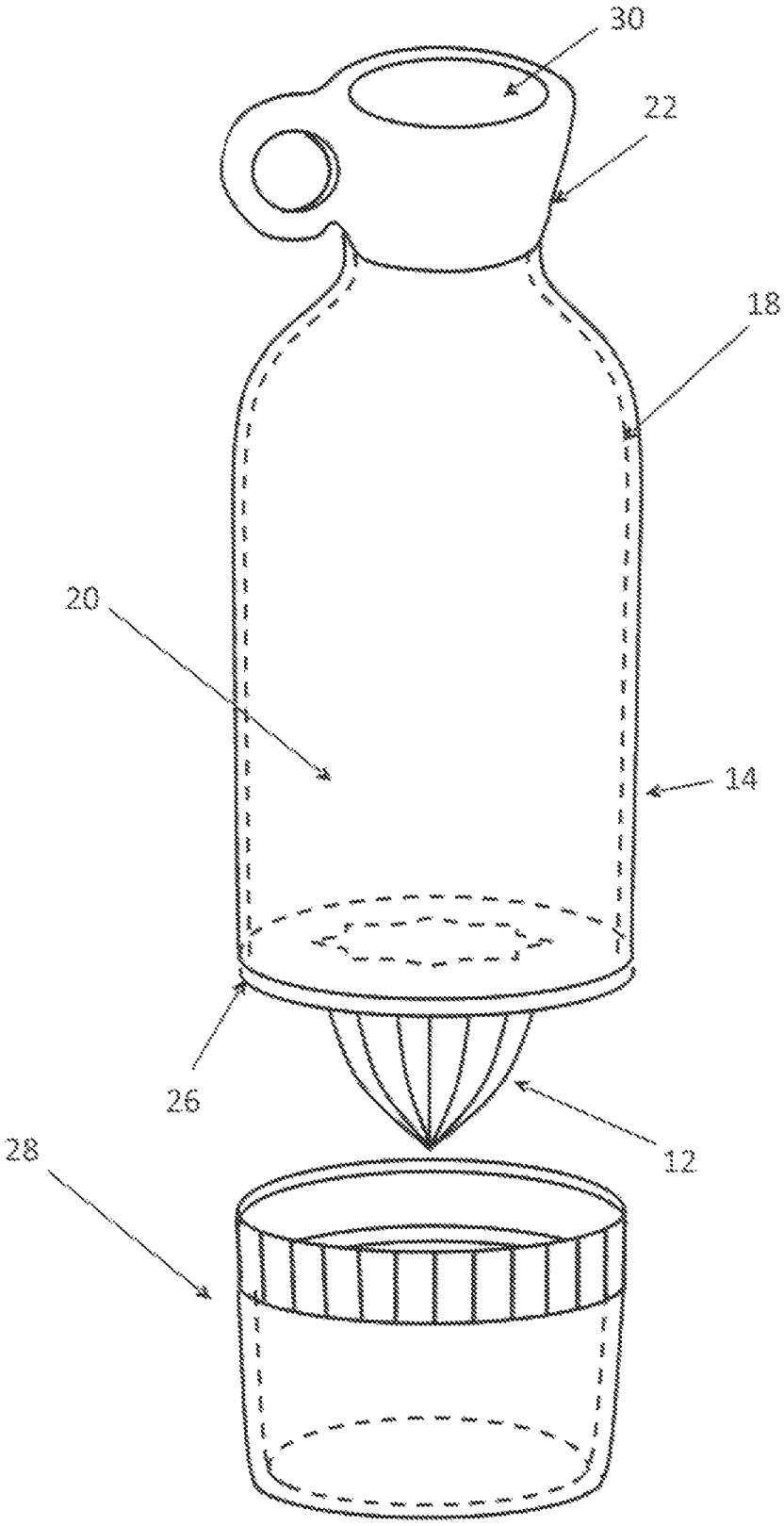
FIG. 6 is a partially exploded perspective view thereof.
Figure 7:
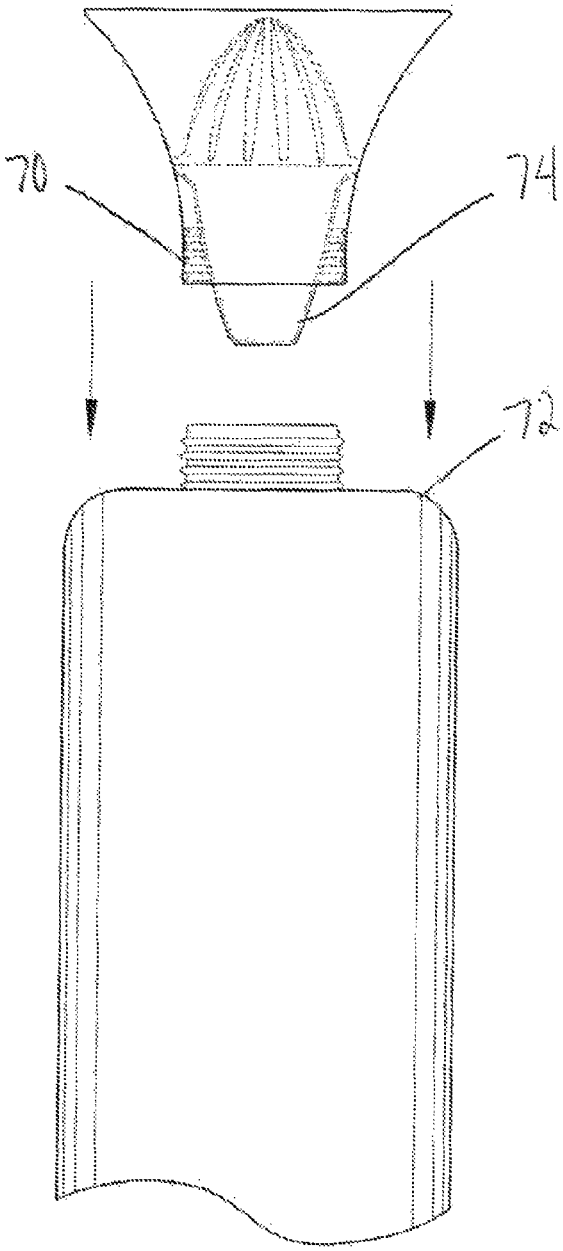
FIG. 7 is an exploded front elevational view of a hand grinding citrus press in combination with a drinking vessel with screw groove and corking device.
Figure 8:
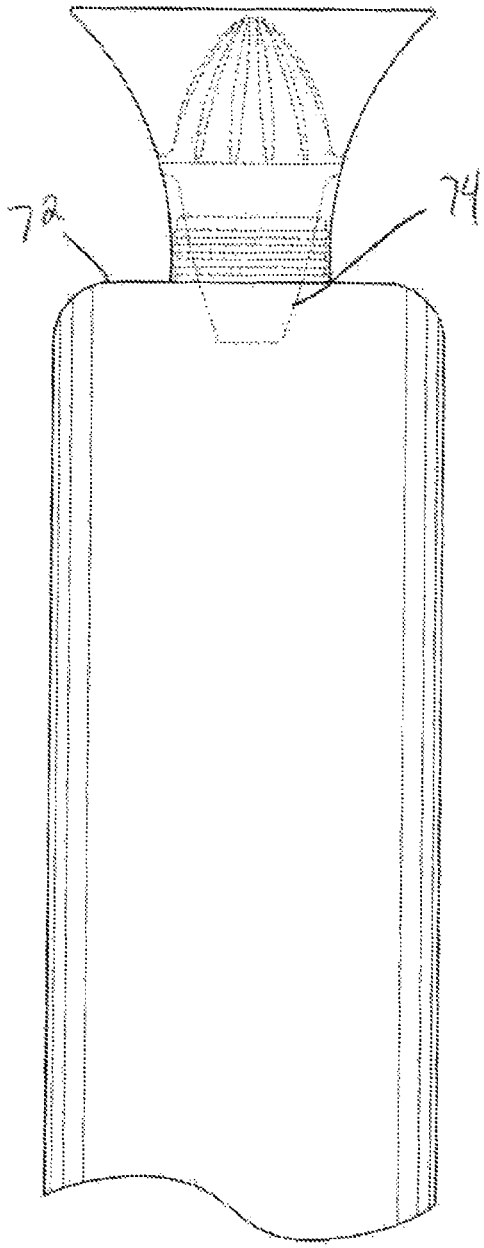
FIG. 8 is a front elevational view of a hand grinding citrus press in combination with a drinking vessel with screw groove and corking device.
Figure 9:
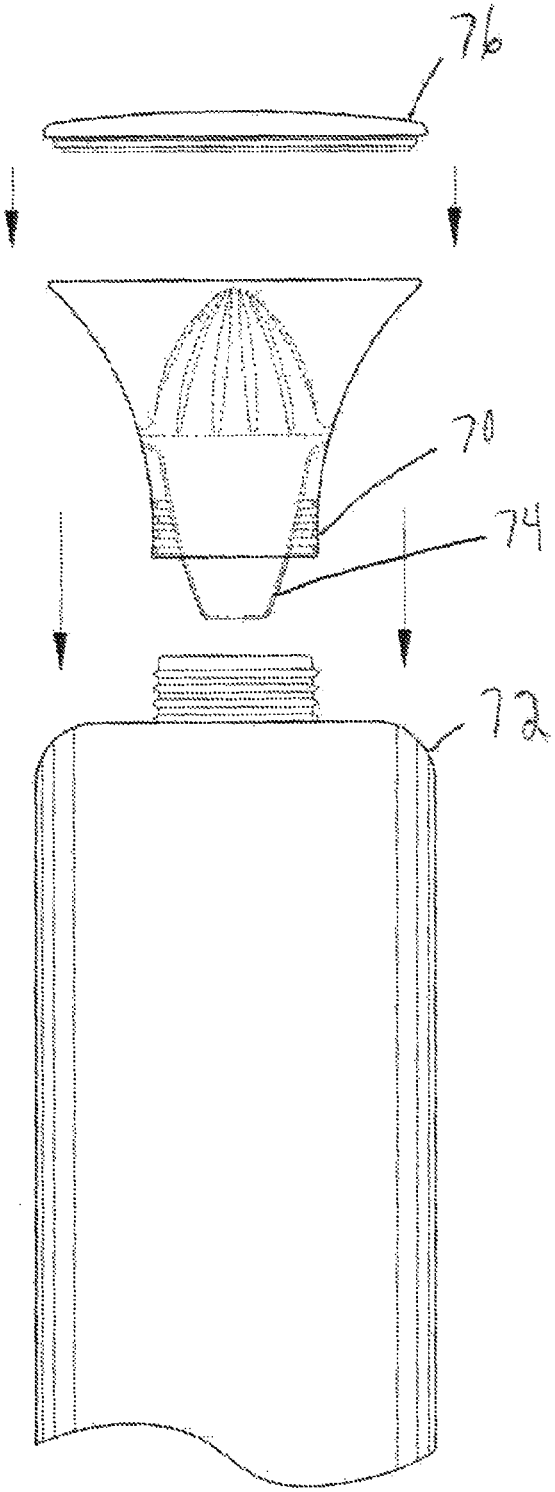
FIG. 9 an exploded front elevational view of a hand grinding citrus press in combination with a drinking vessel with screw groove and corking device with a lid.
Figure 10:
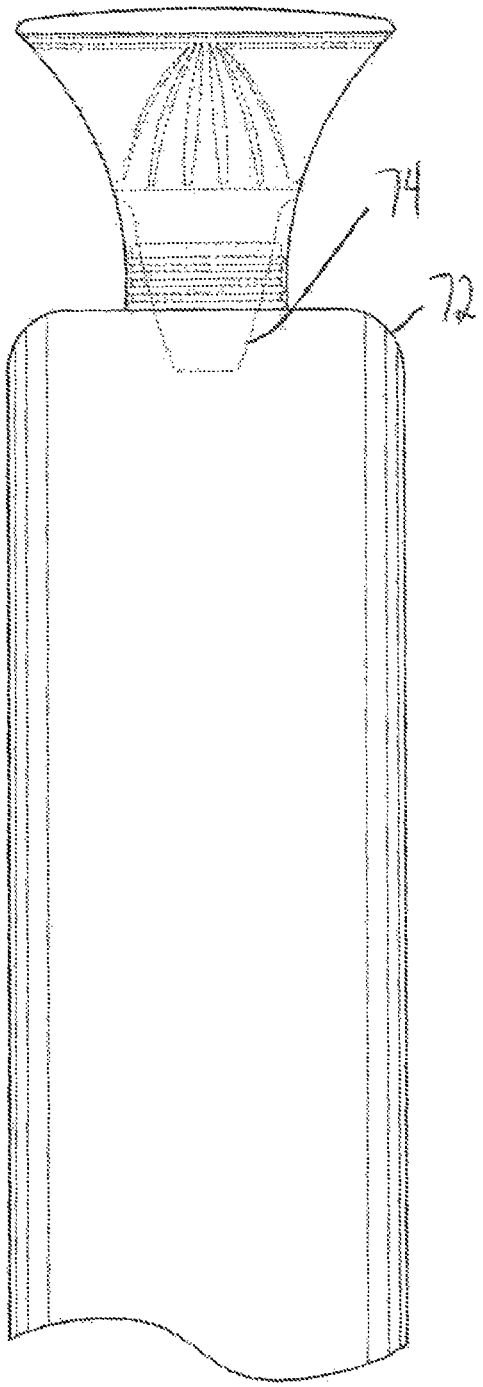
FIG. 10 is a front elevational view of a hand grinding citrus press in combination with a drinking vessel with screw groove and corking device with a lid.

As shown in conjunction with FIGS. 4-6, the citrus press 12 is formed connectedly with the lower surface 26 of the drinking vessel 14. In such an embodiment, the bottom cap 28 can be threadingly engaged directly to the lower surface 26 of the drinking vessel 14. In this manner, a drinking beverage contained therein can be infused with the essences from ground or comminuted fruit that is created when a fruit is impinged between the bottom cap 28 and citrus press 12. The fluid communication between the comminuting volume of the citrus press 12 and the vessel 14 allows these all natural ingredients to steep directly with the beverage.

As shown in conjunction with FIGS. 7-10, in one embodiment, the citrus press 12 comprises screw grooves 70 to removably attach to a screw on vessel 72. The citrus press 12 can also be adapted to comprise a corking device 74 for removably securing to a screw on vessel 72. The citrus press 12 in this embodiment can be designed with an open end without a lid 76, or can be designed with a closed, sealed and contained having a lid 76. The citrus press 12 in this embodiment accommodates a citrus based fruit to be hand presses and/or grinded against the press to extract the juices, allowing them to funnel directly into the vessel 72.

It is anticipated that a number of beverage options can exist, such as water, tea, vodka or other spirits. When adapted for use with drinking water, a drinking spout 30 may be provided to provide a spill-proof sip. When adapted for use with tea or other steeped beverages, the drinking vessel 14 may further include a café cap (not shown) that allows for spill-proof sipping. When adapted for use in bartending, similar accommodation can be provided to allow for use with liquors and even wine.

Given this broad anticipation, of functionality, it should be obvious to a person having ordinary skill in the relevant art to find that adaptations or changes to the form or particular intended use of the container 10 would be equivalent to the present invention, or merely a design choice or alteration, or both. In any embodiment, the drinking vessel 14 is operatively connected to the citrus press 12 and the citrus press 12 is removably connected to the liquid drinking vessel 14, as well as in fluid communication with the dispensing volume 20. While the embodiments presented herein are shown to anticipate the use of a bottom cap 28 affixing to or received by the bottom of the vessel 14, such embodiments were selected as preferred design choices that enable the present invention, but were not intended as being strict limitations. Placement of the citrus press 12 at the top, middle, or any specific orientation or configuration should be equivalent, given the fluid communication between the comminuted foodstuff and the dispensing volume 20 such that the extraction of edible and aromatic oils can directly blend with any liquid contents of the dispensing volume 20.

2. Operation of the Preferred Embodiment

In accordance with a preferred embodiment of the present invention, as shown in either embodiment, the operation of the present invention is accomplished by placing citrus or other foodstuffs, such as fruit, in the bottom cap 28 and contained between the sieve 16. The assembly is then threadingly engaged onto the bottom of a vessel 14, and the vessel 14 filled with a dispensing volume 20. The user is now able to grind any fruit directly into the dispensing volume 20. This direct contact allowing the all natural ingredients to steep directly into the dispensing volume 20 creates refreshingly flavored drinks and directly capturing nutrients or edible or aromatic extracts. The infused liquid can be consumed or used directly or indirectly from the vessel 14, and can be refrigerated after mixing. When emptied, the old ingredient can be discarded and the assembly components washed in preparation for reuse. The foregoing descriptions of specific multiple embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

Having thus described the invention what is claimed as new and desired to be secured by Letters Patent is as follows:

1. An essence extractor and liquid container comprising:

a citrus press in combination with;

a liquid drinking vessel;

wherein said drinking vessel forms a leak proof, integrated storage and dispensing volume that is in fluid communication with comminuted foodstuffs and freshly extracted edible and aromatic oils discharged from said citrus press such that the direct, continuous blending of said comminuted foodstuffs and said freshly extracted edible and aromatic oils are mixed with the dispensing volume contained within said drinking vessel and dispensed therefrom in a manner adapted for drinking.

2. The essence extractor and liquid container combination of claim 1, wherein said drinking vessel is adapted to dispense said liquid as a beverage from said drinking vessel directly for consumption while said citrus press is still attached to said beverage container.

3. The essence extractor and liquid container combination of claim 1, wherein said drinking vessel is adapted to dispense said liquid from said drinking vessel regardless of whether said citrus press is attached or removed from said beverage container.

4. The essence extractor and liquid container combination of claim 1, wherein said liquid drinking vessel is formed of material selected from the group consisting of: stainless steel; and plastic that is free of BPA (Bis-Phenol A).

5. The essence extractor and liquid container combination of claim 2, wherein said liquid drinking vessel further forms a viewing window to allow visual access to said dispensing volume.

6. The essence extractor and liquid container combination of claim 1, wherein said container is adapted for specific use with a beverage liquid and further comprises a drinking spout for dispensing contents from said dispensing volume.

7. The essence extractor and liquid container combination of claim 1, wherein said container is operatively connected to said citrus press such that said citrus press removably connects to the liquid drinking vessel, as well as being in fluid communication with said dispensing volume.

8. The essence extractor and liquid container combination of claim 1, said hand grinding citrus press further comprising screw grooves for removably attaching to a screw on vessel.

9. The essence extractor and liquid container combination of claim 6, wherein said hand grinding citrus press is in an open configuration and does not have a lid.

10. The essence extractor and liquid container combination of claim 6, wherein said hand grinding citrus press is closed, sealed, and contained with a lid.

11. The essence extractor and liquid container combination of claim 1, wherein said hand grinding citrus press further comprises a corking device for securing to said vessel.

12. The essence extractor and liquid container combination of claim 1, wherein said citrus press is contained within the volume of said drinking vessel.

13. An essence extractor and liquid container for the extraction and infusion of edible and aromatic oils into a consumable liquid comprising:

a citrus press in combination with;

a liquid drinking vessel that is removably connected to said citrus press, said liquid drinking vessel further forming a storage and beverage dispensing fluid volume in continuous fluid communication with said citrus press such that the direct blending of freshly extracted edible and aromatic oils is available, wherein said liquid drinking vessel is adapted for leak proof containment of said comminuted foodstuffs and an infused liquid while said citrus press is attached to said liquid drinking vessel; and a separation mechanism between said citrus press and said liquid drinking vessel, said separation mechanism adapted to obstruct physical communication of comminuted foodstuffs into said storage and dispensing fluid volume while permitting fluid communication of said comminuted foodstuffs and freshly extracted edible and aromatic oils with said storage and dispensing fluid volume.

14. The essence extractor and liquid container combination of claim 13, wherein said liquid drinking vessel further allows visual access to said dispensing fluid volume.

* * * * *